US007494009B2

(12) United States Patent
Shiao

(10) Patent No.: US 7,494,009 B2
(45) Date of Patent: Feb. 24, 2009

(54) GOLF BAG FRAME WITH A LEG ASSEMBLY

(76) Inventor: Kun-Lin Shiao, No. 14, Shih 1st Rd., Youth Ind. Park, Yangmei Chen, Taoyuan Hsien (TW)

( * ) Notice: Subject to any disclaimer, the term of this patent is extended or adjusted under 35 U.S.C. 154(b) by 818 days.

(21) Appl. No.: 11/149,351

(22) Filed: Jun. 10, 2005

(65) Prior Publication Data

US 2006/0278768 A1 Dec. 14, 2006

(51) Int. Cl.
*A63B 55/00* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS 4,676,464 A * 6/1987 Reimers ..... 248/96
4,778,136 A * 10/1988 Reimers ..... 248/96
5,469,960 A * 11/1995 Yuill ..... 206/315.3
5,474,176 A * 12/1995 Schenkkan ..... 206/315.7
6,652,045 B1 * 11/2003 Jungkind ..... 206/315.7

* cited by examiner

*Primary Examiner*—Tri M Mai
(74) *Attorney, Agent, or Firm*—Bacon & Thomas, PLLC

(57) ABSTRACT

A golf bag frame and an outer covering form a golf bag, and the golf bag frame has a base, multiple posts, a top frame and a leg assembly. The base has a bottom frame and foot attached pivotally to the bottom frame. The posts are attached to the bottom frame. The top frame is attached to the posts. The leg assembly is attached to the top frame and has a bracket, a pivot rod, a cord and two legs. The bracket is attached to the top frame. The pivot rod extends rotatably through the bracket, has two ends and comprises an activating lever and two springs. The activating lever is connected to the pivot rod. The springs mount around and bias the pivot rod. The cord is connected to the foot and the activating lever. The legs attach respectively to ends of the pivot rod and extend away from the body when the foot is pivoted to an inclined position.

5 Claims, 6 Drawing Sheets

GOLF BAG FRAME WITH A LEG ASSEMBLY

BACKGROUND OF THE INVENTION

1. Field of the Invention

The present invention relates to a golf bag frame, and more particularly to a golf bag frame with a leg assembly that can stand stably on the ground.

2. Description of Related Art

Golf bags hold golf clubs. A conventional golf bag is cylindrical and has a flat bottom so that the golf bag can stand upright on the ground. However, the grassy of most golf courses is not flat. A golf bag standing on the grass may easily fall over.

With reference to FIGS. 5 and 6, a conventional golf bag with an integral bipod stand can stand stably on sloping grass and comprises a bag body (91), two legs (92), a pivot bracket (93), two activating rods (94) and multiple guide brackets (95). The bag body (91) has an open top, a bottom and a sidewall. The legs (92) are attached pivotally on the sidewall of the bag body (91) close to the top, and each leg (92) has a proximal end. The pivot bracket (93) is mounted pivotally on the bottom of the bag body (91), has a flat bottom and contacts the ground when the golf bag (91) stands on the ground. The activating rods (94) are connected pivotally to the pivot bracket (93), and each activating rod (94) has a distal end. The distal ends of the activating rods (94) are pivotally attached respectively to the legs (92) near the proximal ends of the legs (92). The guides (95) are mounted on the sidewall, and each guide (95) has two through holes through which the activating rods (94) respectively extend. Inclining the bag body (91) relative to the pivot bracket (93) causes the activating rods (92) to pivot the legs (92) away from the bag body (91) so that the golf bag can stand obliquely and stably on the ground.

However, the activating rods (94) are exposed and are damaged or broken easily in the course of normal use, and dust, dirt, corrosion or other debris easily accumulates in the through holes in the guides (95) and restricts the movement of the activating rods (94) through the guides (95).

To overcome the shortcomings, the present invention provides a golf bag frame with a leg assembly to mitigate or obviate the aforementioned problems.

SUMMARY OF THE INVENTION

The main objective of the invention is to provide a golf bag frame with a leg assembly that can stand stably anywhere on a golf course.

A golf bag frame in accordance with the present invention and an outer covering form a golf bag, and the golf bag frame comprises a base, multiple posts, a top frame and a leg assembly.

The base has a bottom frame and a foot attached pivotally to the bottom frame.

The posts are attached to the bottom frame.

The top frame is attached to the posts.

The leg assembly is attached to the top frame and has a bracket, a pivot rod, a cord and two legs. The bracket is attached to the top frame. The pivot rod extends rotatably through the bracket, has two ends and comprises an activating lever and two springs. The activating lever is connected to the pivot rod. The springs mount around and bias the pivot rod. The cord is connected to the foot and the activating lever. The legs attach respectively to ends of the pivot rod and extend away from the body when the foot is pivoted to an inclined position.

Other objectives, advantages and novel features of the invention will become more apparent from the following detailed description when taken in conjunction with the accompanying drawings.

DETAILED DESCRIPTION OF PREFERRED EMBODIMENT

Figure 1:
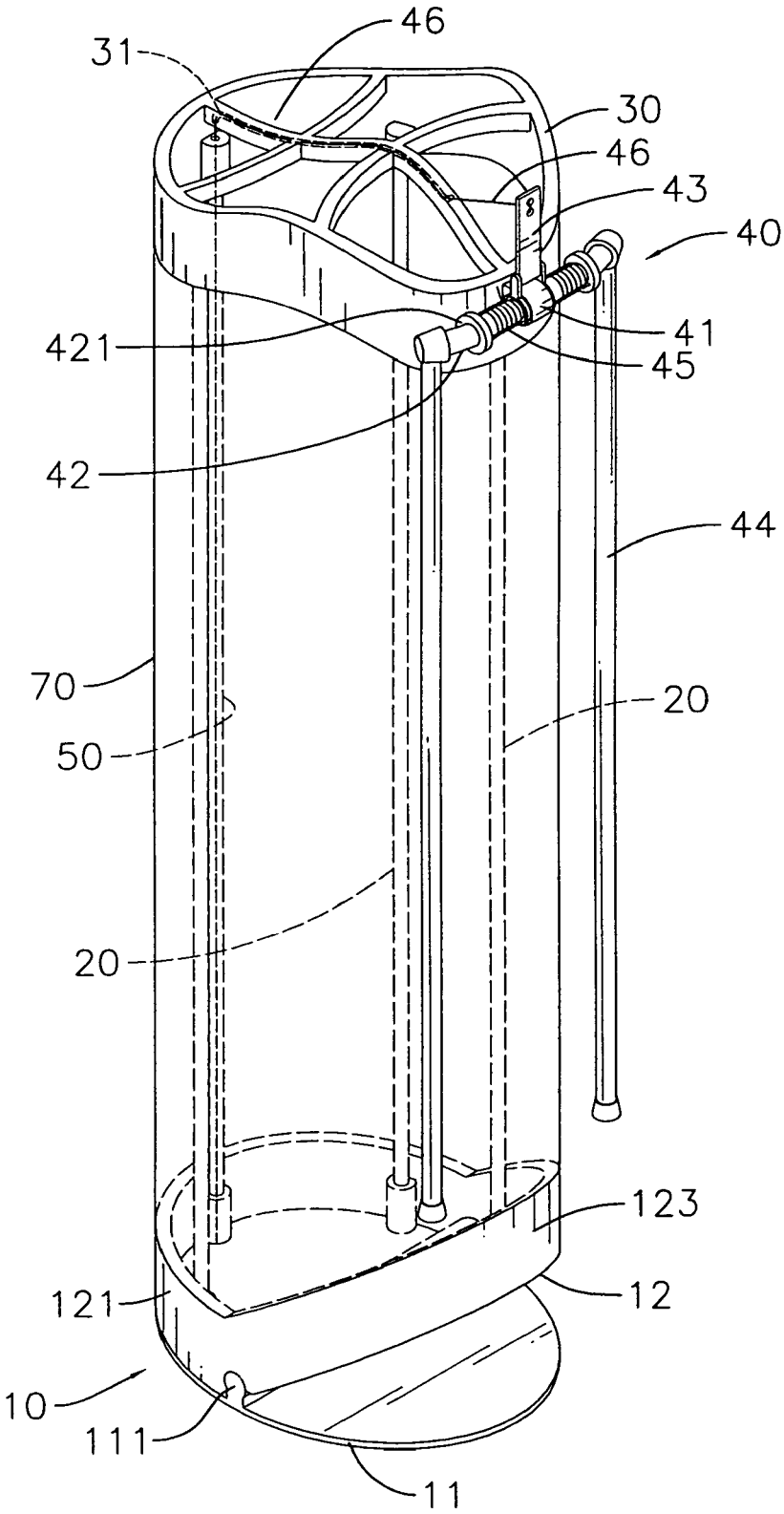
FIG. 1 is a perspective view of a golf bag with an outer covering and a golf bag frame in accordance with the present invention.
Figure 2:
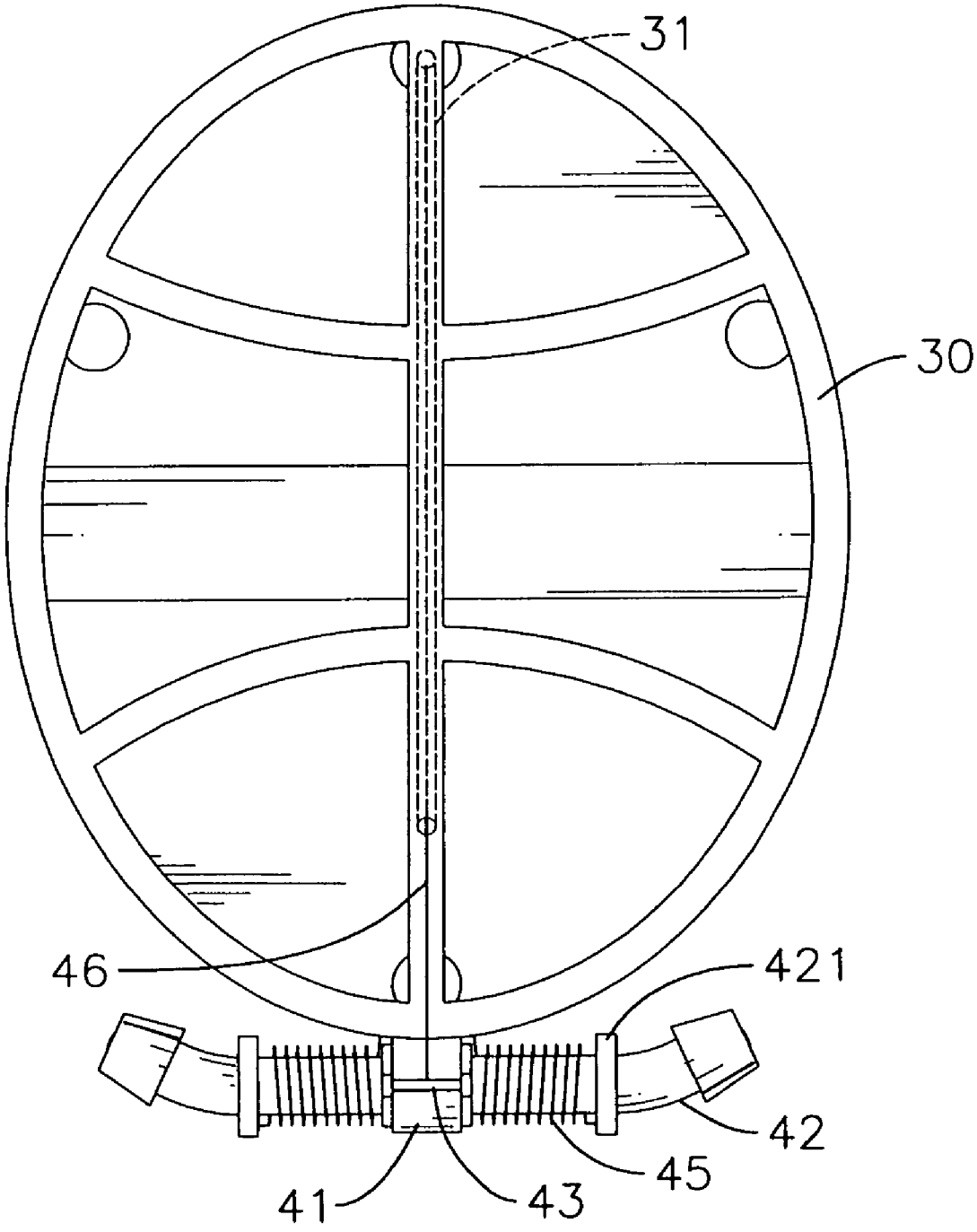
FIG. 2 is a top view of the golf frame in FIG. 1.

With reference to FIGS. 1 and 2, a golf bag frame in accordance with present invention is used with an outer covering (70) to form a golf bag. The outer covering (70) is made of cloth or leather and is mounted around the golf bag frame to form a golf bag.

The golf bag frame comprises a base (10), multiple posts (20), a top frame (30), an optional cord guide (50) and a leg assembly (40).

The base (10) may be put on the ground and has a bottom frame (12) and a foot (11). The bottom frame (12) has a bottom and an annular sidewall. The bottom has a level front segment (121), an inclined rear segment (123) and a mounting groove. The inclined rear segment (123) is inclined up relative to the level front segment (121). The mounting groove is formed diametrically in the bottom between the level front segment (121) and the inclined rear segment (123). The annular sidewall is formed around the bottom. The foot (11) is attached pivotally to the bottom frame (12), selectively pivots to a transverse position against the level front segment (121) of the bottom or an inclined position against the inclined rear segment (123) of the bottom, may be set on the ground and has a front edge, a rear edge and a pivot element (111). The pivot element (111) may be a pivot spine, is formed diametrically on and extends up from the foot (11) and is pivotally mounted in the mounting groove in the bottom of the bottom frame (12).

The posts (20) are attached to and extend up from the sidewall of the bottom frame (12), and each post (20) has a top end.

The top frame (30) is mounted on the top ends of the posts (20) and has an outer surface, an inner surface and a divider. The divider has a crossbar, multiple branches and a passage (31). The crossbar is attached longitudinally to the inner surface of the top frame (30). The branches extend from the crossbar and are attached to the inner surface of the top frame (30) to divide a space inside the top frame (30) into multiple sub spaces. The divider allows the golf clubs of different types to respectively extend through the sub spaces. The passage (31) is defined longitudinally through the crossbar of the divider in the top frame (30) and has a front opening above the level front segment (121) of the bottom frame (12) and a rear opening above the inclined rear segment (123).

The cord guide (50) is mounted between the bottom frame (12) and the top frame (30), is aligned with the level front segment (121) and has a through hole defined longitudinally through the cord guide (50) and aligned with front opening of the passage (31) in the divider in the top frame (30).

The leg assembly (40) is attached to the top frame (30) and has a bracket (41), a pivot rod (42), a cord (46) and two legs (44).

The bracket (41) is securely attached to the outer surface of the top frame (30), is aligned with the inclined rear segment (123) of the bottom frame (12) and has a through hole defined transversely through the bracket (41).

The pivot rod (42) is mounted rotatably in and extends through the through hole in the bracket (41) and has two ends, two optional annular flanges (421), an activating lever (43) and two springs (45). The annular flanges (421) are formed on the pivot rod (42) respectively toward the ends, and each annular flange (421) has an inner surface and a mounting hole defined in the inner surface of each annular flange (421).

The activating lever (43) is connected securely to and extends radially out from the pivot rod (42) between the two ends of the pivot rod (42) and has a distal end and two sides.

The springs (45) are mounted around the pivot rod (42) and apply a torsional restitution force to the pivot rod (42), and each spring (45) has an outer end and an inner end. The outer end of each spring (45) is securely attached to the pivot rod (42) and may be mounted in the mounting hole in the corresponding annular flange (421). The inner ends of the springs (45) extend tangentially out from the springs (45) and abut the outer surface of the top frame (30).

Figure 3:
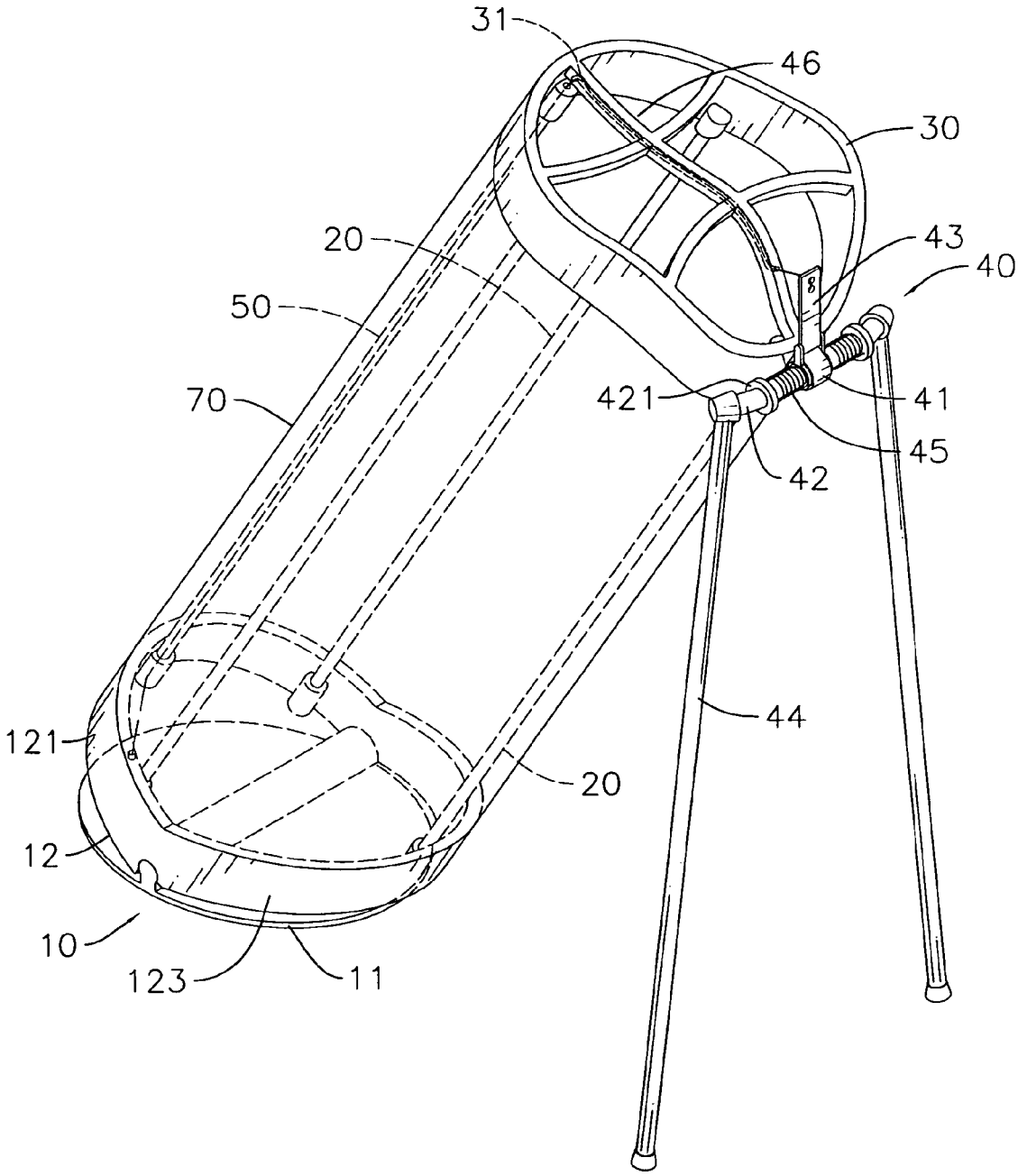
FIG. 3 is an operational perspective view of the golf bag frame in FIG. 1.
Figure 4:
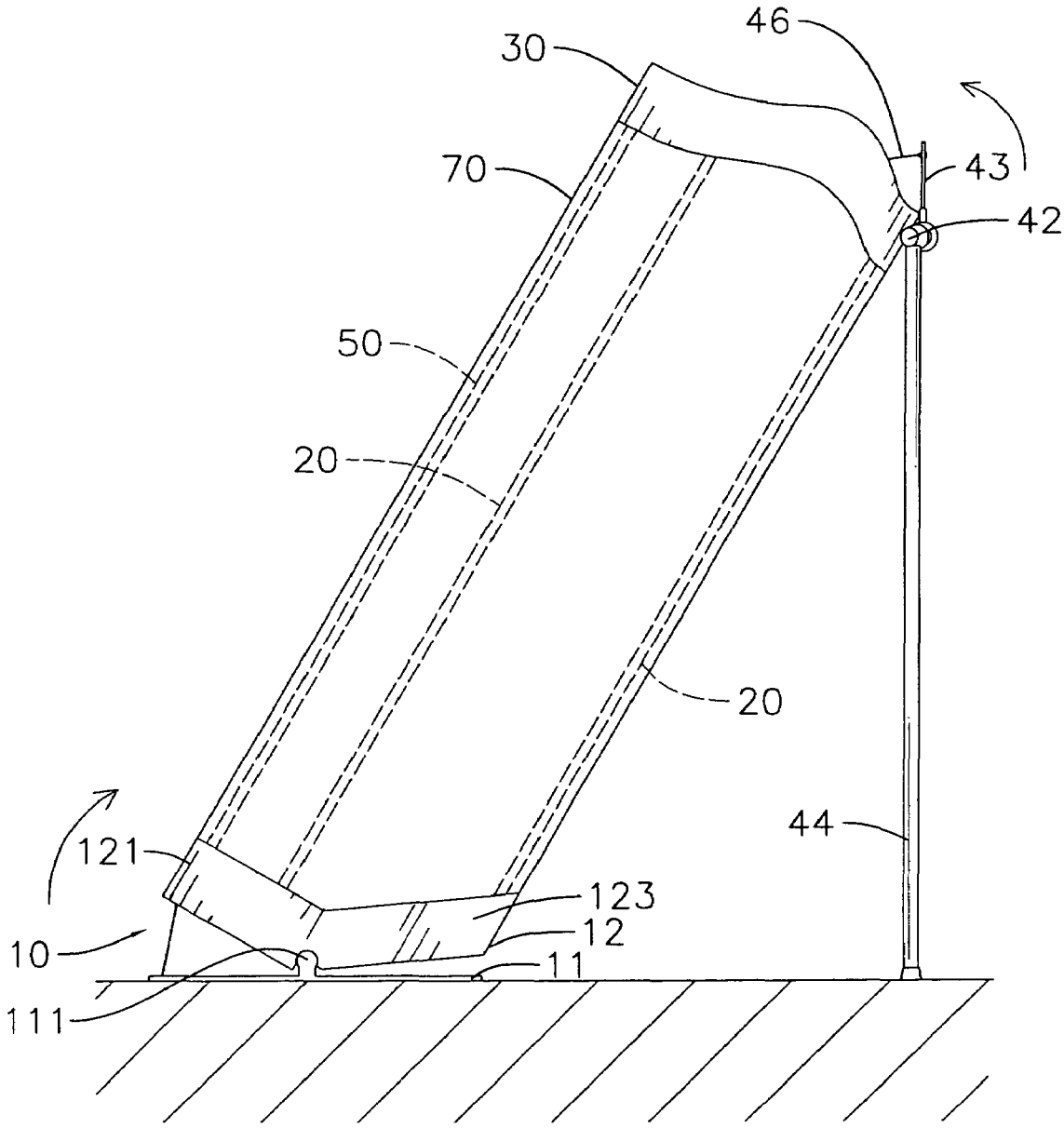
FIG. 4 is an operational side view of the golf bag frame in FIG. 3.
Figure 5:
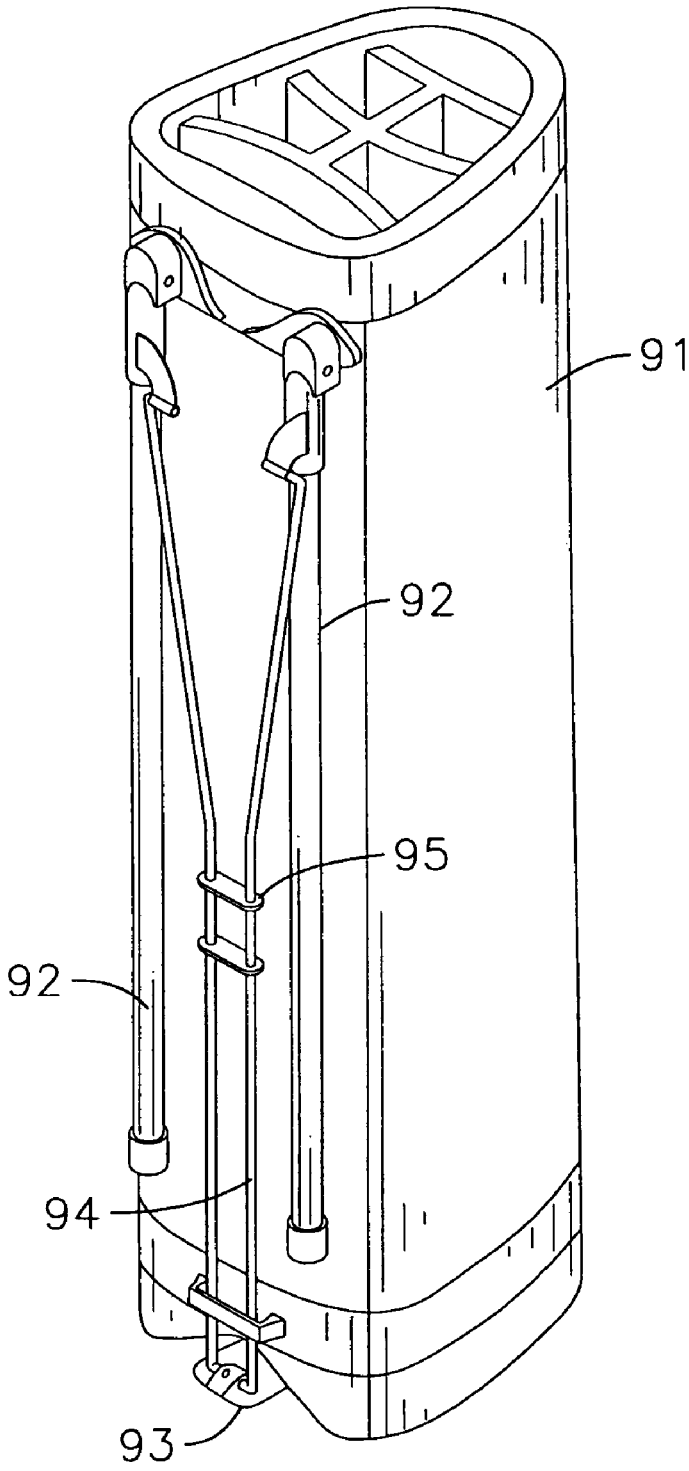
FIG. 5 is a perspective view of a conventional golf bag in accordance with the prior art.
Figure 6:
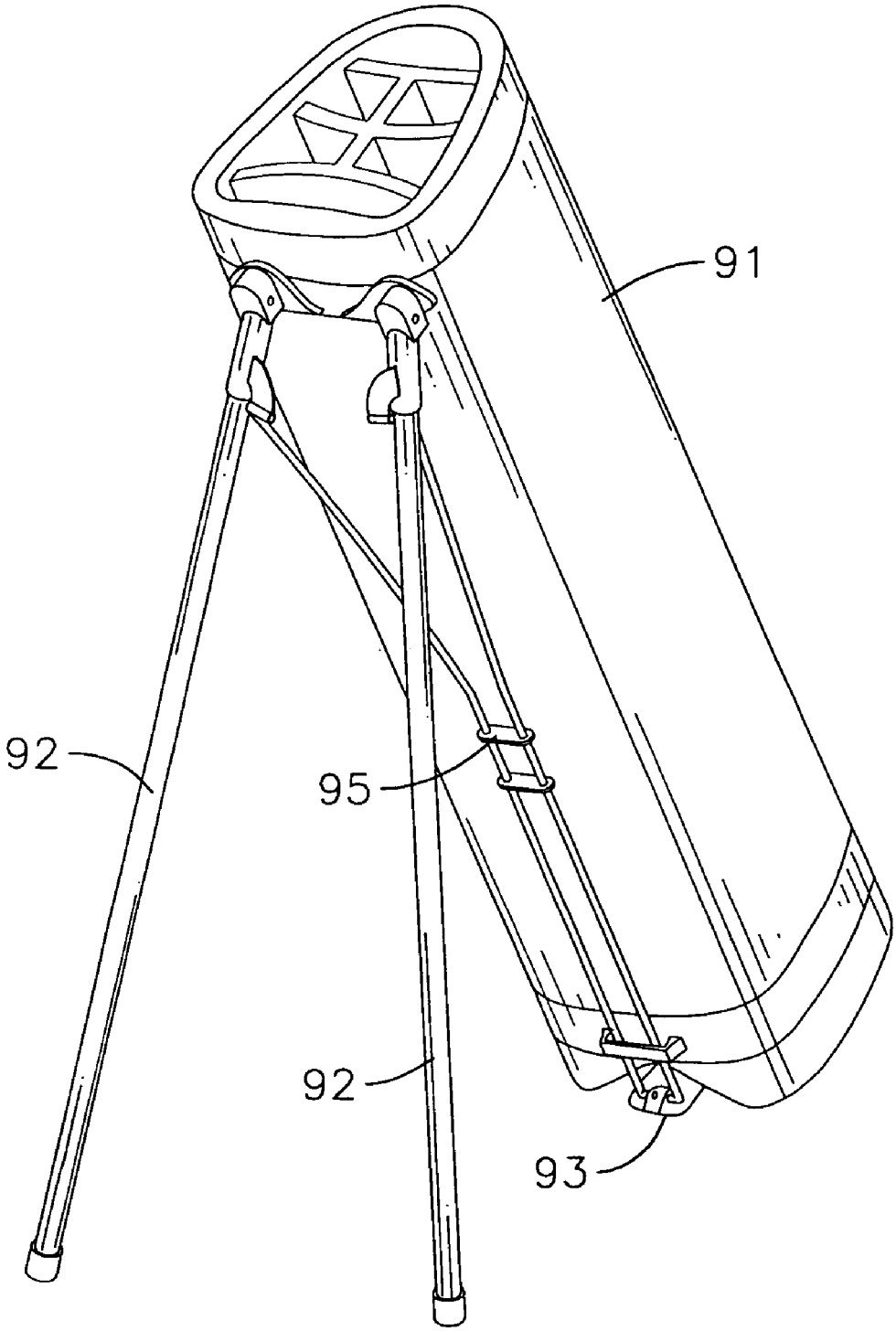
FIG. 6 is an operational perspective view of the golf bag in FIG. 6.

The cord (46) may be a fiber cord or a metal cable, is connected to the distal end of the activating lever (43) and the foot (11) of the base (10) near the front edge and extends through the passage (31) in the divider in the top frame (30) and the through hole in the cord guide (50). With reference to FIGS. 3 and 4, the cord (46) pulls the activating lever (43) and rotates the pivot rod (42) in the bracket (41) when the foot (11) of the base (10) contacts the ground and pivots against the inclined rear segment (123) of the bottom frame (12).

The legs (44) are attached respectively to the ends of the pivot rod (42) and are held parallel to the posts (20) and the outer covering (70) by the springs (45) when the foot (11) is not abutting the ground. The legs (44) extend out when the foot (11) pivots against the inclined rear segment (123) of the bottom of the bottom frame (123) and securely hold the golfbag. Therefore, the golf bag with the legs (44) keeps articles such as golf clubs in the golf bag from falling off. Furthermore, the springs (45) keep the leg from swaying so that golf players can easily carry the golf bag.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A golf bag frame comprising:

a base having a bottom frame having a bottom having a level front segment and an inclined rear segment inclined up relative to the level front segment; and an annular sidewall formed around the bottom; and a foot attached pivotally to the bottom frame to selectively pivot to a transverse position against the level front segment of the bottom or an inclined position against the inclined rear segment of the bottom and having a front edge, a rear edge, and a pivot element formed on and extending up from the foot and pivotally mounted on the bottom;

multiple posts attached to and extending up from the sidewall of the bottom frame, and each post having a top end;

a top frame mounted on the top ends of the posts and having an outer surface and an inner surface;

a cord guide mounted between the bottom frame and the top frame, aligned with the level front segment of the bottom frame and having a through hole defined longitudinally through the cord guide; and a leg assembly attached to the top frame and having a bracket securely attached to the outer surface of the top frame, aligned with the inclined rear segment of the bottom frame and having a through hole defined transversely through the bracket;

a pivot rod rotatably mounted in and extending through the through hole in the bracket, having two ends;

an activating lever connected securely to and extending radially out from the pivot rod between the two ends of the pivot rod and having a distal end and two sides; and two springs mounted around the pivot rod to apply a torsional restitution force to the pivot rod, and each spring having an outer end securely attached to the pivot rod and an inner end extending out from the springs and abutting the top frame;

a cord connected to the distal end of the activating lever and the foot of the base near the front edge and extending through the through hole in the cord guide; and two legs attached respectively to the ends of the pivot rod.

2. The golf bag frame as claimed in claim 1, wherein:

the top frame further has a divider having a crossbar attached longitudinally to the top frame;

multiple branches extending from the crossbar and attached to the top frame; and a passage defined longitudinally through the crossbar of the divider in the top frame and having a front opening above the level front segment of the bottom frame and a rear opening above the inclined rear segment; and the cord extends through the passage in the divider in the top frame.

3. The golf bag frame as claimed in claim 2, wherein the pivot rod further has two annular flanges formed on the pivot rod respectively toward the ends, and each annular flange has an inner surface and a mounting hole defined in the inner surface and in which the outer end of a corresponding spring is securely mounted.

4. The golf bag frame as claimed in claim 3, wherein the cord is a fiber cord.

5. The golf bag as claimed in claim 3, wherein the cord is a metal cable.

* * * * *